US009073173B2

(12) United States Patent
Takai et al.

(10) Patent No.: US 9,073,173 B2
(45) Date of Patent: Jul. 7, 2015

(54) METHOD FOR SHAPE MODIFICATION OF POLISHING PAD

(75) Inventors: Hiroshi Takai, Tokyo (JP); Yuichi Nakayoshi, Tokyo (JP)

(73) Assignee: SUMCO Corporation, Tokyo (JP)

( * ) Notice: Subject to any disclaimer, the term of this patent is extended or adjusted under 35 U.S.C. 154(b) by 1127 days.

(21) Appl. No.: 12/981,305

(22) Filed: Dec. 29, 2010

(65) Prior Publication Data

US 2011/0171885 A1 Jul. 14, 2011

(30) Foreign Application Priority Data

Jan. 13, 2010 (JP) ..... 2010-004807

(51) Int. Cl.

| | |
|---|---|
| ***B24B 1/00*** | (2006.01) |
| ***B24B 49/18*** | (2006.01) |
| ***B24B 37/04*** | (2012.01) |
| ***B24B 53/017*** | (2012.01) |
| ***B24B 27/00*** | (2006.01) |

(52) U.S. Cl.

CPC ..... *B24B 49/18* (2013.01); *B24B 37/042* (2013.01); *B24B 53/017* (2013.01); *B24B 27/0076* (2013.01)

(58) Field of Classification Search

CPC ..... B24B 53/017

USPC ..... 451/5, 8, 41, 56, 285–290, 443, 444

See application file for complete search history.

(56) References Cited

U.S. PATENT DOCUMENTS

| | | | | |
|---|---|---|---|---|
| 4,300,522 | A * | 11/1981 | Henry et al. | 125/11.01 |
| 4,607,607 | A * | 8/1986 | Janutta et al. | 125/11.03 |
| 6,343,977 | B1 * | 2/2002 | Peng et al. | 451/56 |
| 6,976,907 | B2 * | 12/2005 | Golzarian et al. | 451/56 |
| 7,004,822 | B2 * | 2/2006 | Moloney et al. | 451/56 |
| 2001/0015801 | A1 | 8/2001 | Hirose et al. | |
| 2002/0102917 | A1 * | 8/2002 | Lee et al. | 451/21 |

(Continued)

FOREIGN PATENT DOCUMENTS

| | | |
|---|---|---|
| EP | 0816017 A1 | 1/1998 |
| JP | 2002-270556 | 9/2002 |

(Continued)

OTHER PUBLICATIONS

European Extended Search Report in corresponding European Application No. 11150459.3, mailed Sep. 1, 2014 (7 pages).

*Primary Examiner* — Maurina Rachuba

(74) *Attorney, Agent, or Firm* — Thomas J. Engellenner; Reza Mollaaghababa; Pepper Hamilton LLP

(57) ABSTRACT

A polishing pad shape measured by a polishing pad shape measuring apparatus is modified into a target shape of a polishing pad by using a dressing tool so that a wafer has a desired surface shape. The invention is a method for shape modification of a polishing pad 14 for polishing a workpiece into a desired surface shape, comprising: a measurement step S9 of measuring a polishing pad shape in a state of being attached to a plate 12 by using a polishing pad shape measuring apparatus 10; a condition determination step S10 of selecting a dressing recipe capable of polishing the workpiece into a desired surface shape from a plurality of pre-provided dressing recipes based on the measurement result in the measurement step S9; and a shape modification step S11 of dressing the polishing pad 14 by using the dressing recipe determined in the condition determination step S10.

8 Claims, 4 Drawing Sheets

(56) References Cited

U.S. PATENT DOCUMENTS

| | | | | |
|---|---|---|---|---|
| 2002/0164932 | A1 | 11/2002 | Kamimura et al. | |
| 2003/0162486 | A1 | 8/2003 | Stoeckgen et al. | |
| 2008/0009231 | A1* | 1/2008 | Stinson et al. | 451/443 |
| 2010/0035520 | A1* | 2/2010 | Tanaka et al. | 451/8 |
| 2010/0081361 | A1* | 4/2010 | Fukuda et al. | 451/5 |
| 2010/0197197 | A1* | 8/2010 | Nakayoshi et al. | 451/5 |

FOREIGN PATENT DOCUMENTS

| | | | | | |
|---|---|---|---|---|---|
| JP | 2002270556 | A | * | 9/2002 | H01L 21/304 |
| JP | 2004-090142 | | | 3/2004 | |
| TW | 200946284 | | | 11/2009 | |
| WO | 0132360 | A1 | | 5/2001 | |
| WO | WO 01/32360 | A1 | * | 5/2001 | B24B 5/00 |

* cited by examiner (a) Dressing tool for pad outer periphery portion modification (b) Dressing tool for pad center portion modification

METHOD FOR SHAPE MODIFICATION OF POLISHING PAD

BACKGROUND OF THE INVENTION

1. Field of the Invention

This invention relates to a method for shape modification of a polishing pad for polishing a workpiece, particularly a wafer into a desired surface shape.

2. Description of the Related Art

Conventionally, a polishing apparatus (CMP apparatus) by the chemical mechanical polishing method (CMP method) has been used for polishing and planarizing a workpiece such as a wafer. The CMP apparatus generally includes a polishing plate for polishing a wafer and a polishing head for holding a wafer, and a wafer is polished by pressing the wafer held by the polishing head against the polishing plate and rotating the wafer and the polishing plate while supplying a polishing agent (slurry) between the above two.

Here, a polishing pad is attached to the surface of this polishing plate for polishing a wafer, and the wafer is pressed against this polishing pad and polished. However, since the polishing amount of this polishing pad decreases due to the clogging of the surface and the like, the polishing pad is dressed after polishing a few wafers in the CMP apparatus.

Since a polishing pad is polished on the surface little by little as dressed, the surface shape changes and the flatness tends to gradually deteriorate. When a wafer is polished by using such a polishing pad, a disadvantage is that the wafer cannot be planarized stably with a high degree of accuracy.

Therefore, conventionally, an operator measured the flatness of a polishing pad surface upon performing a dressing, analyzed the polishing amount from the measurement result, and adjusted the dressing.

However, the conventional method of manually measuring the flatness of a polishing pad surface by an operator has a disadvantage of requiring a great amount of time in the measuring operation and being inefficient. Moreover, even though the flatness of a polishing pad itself is adjusted, a variation occurs in the flatness of the polishing pad in a state of being attached to a polishing plate due to the difference between apparatus of the polishing plates where the pad is attached.

In order to solve such problems, a technology of using a contact or noncontact type pad shape measuring apparatus and obtaining the polishing conditions and the dressing conditions based on the measured profile of a polishing pad surface is disclosed as a conventional technology (see JP-A-2002-270556). Also, a technology of setting the angle of a dressing tool so as to perform a uniform dressing without being influenced by a polishing plate shape is disclosed (see JP-A-2004-090142).

SUMMARY OF THE INVENTION

However, in the conventional methods, there is a problem that even though the angle of a dressing tool is set and a polishing pad is dressed, not every wafer can be finally planarized due to influences of the parallelism of a plate and the rigidity of an apparatus.

Thus, the invention focuses attention on the above problem and provides a method for modifying a polishing pad shape measured by a polishing pad shape measuring apparatus into a target shape of the polishing pad by using a dressing tool so that a wafer has a desired surface shape.

The above problem of the invention is solved by a method for shape modification of a polishing pad for polishing a workpiece into a desired surface shape, comprising: a measurement step of measuring a polishing pad shape in a state of being attached to a plate by using a polishing pad shape measuring apparatus; a condition determination step of selecting a dressing recipe capable of polishing the workpiece into a desired surface shape from a plurality of pre-provided dressing recipes based on the measurement result of the measurement step; and a shape modification step of dressing the polishing pad by using the dressing recipe determined in the condition determination step.

Now, it is preferable to determine the dressing recipe by selecting the most suitable dressing tool from a plurality of dressing tools. Moreover, the plurality of dressing tools is preferable to contain at least a dressing tool with a property of modifying the polishing pad from a convex surface to a concave surface and a dressing tool with a property of modifying the polishing pad from a concave surface to a convex surface.

Furthermore, the dressing recipe is preferable to determine at least one of a dressing time, a dressing pressing force, and a dressing tool rotation frequency.

The above invention is preferable to be in an aspect wherein the polishing pad shape measuring apparatus comprises a computing apparatus, this computing apparatus has data showing the relationship between the polishing pad shape and a shape of the workpiece polished by the polishing pad, and the shape of the polished workpiece is estimated from the measurement result of the measurement step. Also, this data is preferable to be data showing the relationship between the PV of the polishing pad and the GBIR value of the wafer.

According to the invention, it is possible to provide a method for modifying a polishing pad shape measured by a polishing pad shape measuring apparatus into a target shape of the polishing pad by using a dressing tool so that a wafer has a desired surface shape.

BRIEF DESCRIPTION OF THE DRAWINGS

The invention will be described with reference to the accompanying drawings, wherein.

DESCRIPTION OF THE PREFERRED EMBODIMENTS

Figure 1:
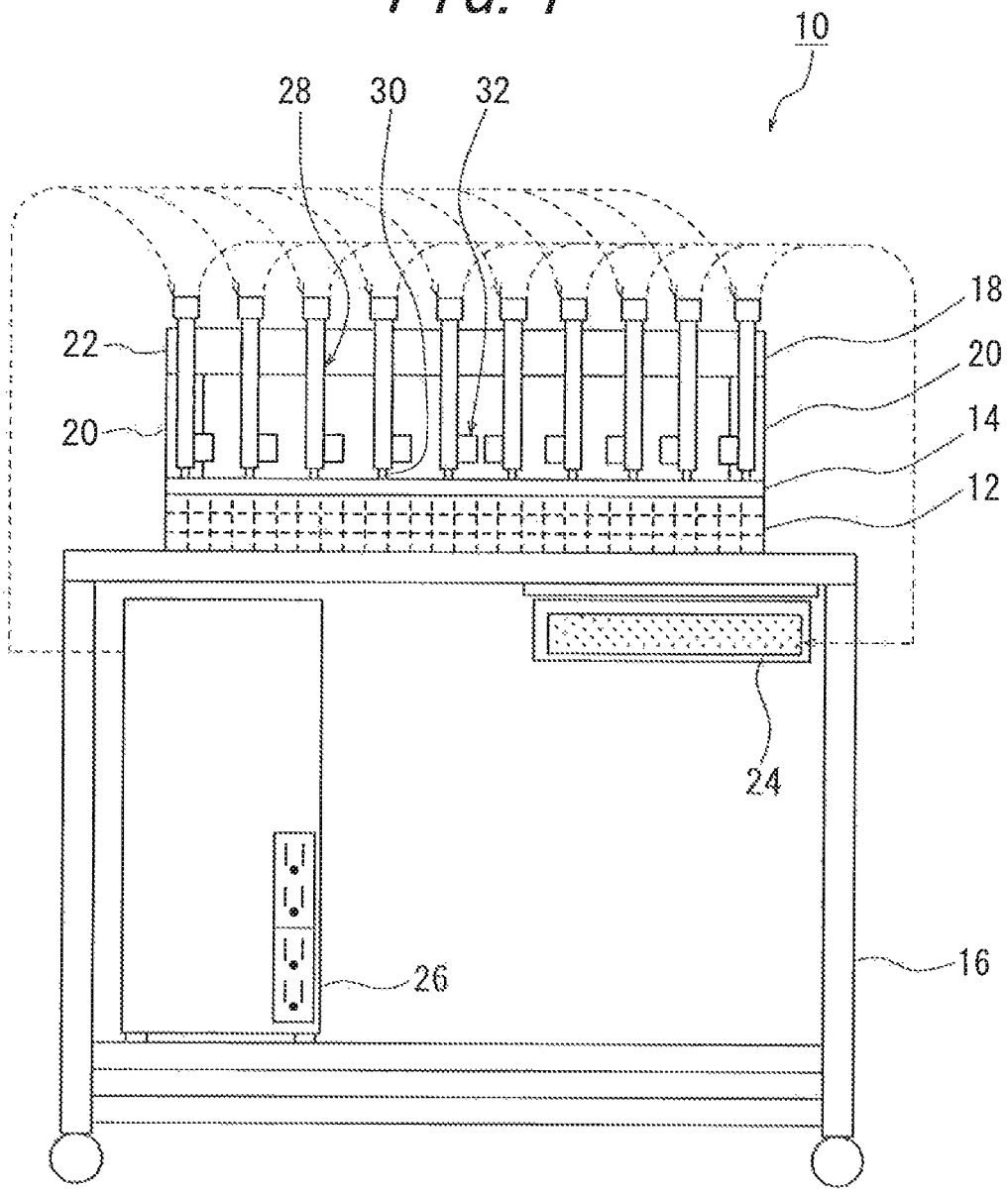
FIG. 1 is an illustrative view of the polishing pad shape measuring apparatus used in the method according to the invention.

In FIG. 1, an example of the polishing pad shape measuring apparatus used in the method according to the invention is shown. A polishing pad shape measuring apparatus 10 is to measure the shape of a polishing pad 14 of insulator formed of resin and the like attached by an adhesive agent onto a plate 12 of metal constituting a semiconductor polishing apparatus. More specifically, this polishing pad shape measuring apparatus 10 does not measure the surface shape of the polishing pad 14 alone, but the shape in combination of the plate 12 and the polishing pad 14. Additionally, the shape is measured in a state where the plate 12 is removed from a semiconductor polishing apparatus (not shown) and placed on a moving measuring table 16 equipped with the polishing pad shape measuring apparatus 10.

A supporting table 18 is a rigid body having a size of at least about the diameters of the plate 12 and the polishing pad 14 in a longitudinal direction, and has a pair of leg portions 20 with a predetermined height and a rail portion 22 connecting the leg portions 20. The supporting table 18 is to be placed on the polishing pad 14, and lower ends of the leg portions 20 are in contact with the polishing pad 14. The rail portion 22 is attached to the leg portions 20 so that the longitudinal direction is parallel. Also, a plurality of length measuring sensors 30 and displacement sensors 32 are provided at predetermined intervals in the longitudinal direction of the rail portion 22, and are all fixed in a state where the sensor head is bent down towards right below.

In addition, the polishing pad shape measuring apparatus 10 used for performing the invention is not limited to the above configuration comprising the length measuring sensors 30 and the displacement sensors 32 at predetermined intervals in the longitudinal direction of the rail portion 22, but may be the one measuring a polishing pad shape while sequentially moving the length measuring sensor 30 and/or the displacement sensor 32, and the like.

The computing apparatus 24 is hardware for operating the polishing pad shape measuring apparatus 10, and is connected to a controlling apparatus 26, the length measuring sensor 30 and the displacement sensor 32. The controlling apparatus 26 supplies electricity for activating the length measuring sensor 30 and the displacement sensor 32 from the computing apparatus 24 to the length measuring sensor 30 and the displacement sensor 32.

The length measuring sensor 30 is connected to the controlling apparatus 26 and the computing apparatus 24, and outputs signals showing a first distance measured from the distance measuring point of the length measuring sensor 30 to the computing apparatus 24 when electricity is supplied from the controlling apparatus 26. The length measuring sensor 30 illuminates laser light on the polishing pad 14 surface, for example, and measures the first distance from the distance measuring point of the length measuring sensor 30 to the upper surface of the polishing pad 14 by using the time up to receive the reflected light thereof.

The displacement sensor 32 is connected to the control apparatus 26 and the computing apparatus 24, and outputs signals of a second distance measured from the distance measuring point of the displacement sensor 32 to the computing apparatus 24 when electricity is supplied from the controlling apparatus 26. The displacement sensor 32 uses an eddy current type displacement sensor, for example. The displacement sensor 32 applies a high frequency current to a coil of the sensor head (not shown), illuminates a high frequency magnetic field towards the plate 12 as metal, and generates an eddy current in the plate 12. Then, the impedance of the coil is changed by this eddy current. As the level of this change varies depending on the distance between the coil and the plate 12, the second distance from the coil to the plate 12 is calculated from the level of this change.

The computing apparatus 24 can display a graph with a traverse axis of the position of a sensor unit 28 (measuring position of the polishing pad 14) and a longitudinal axis of the thickness (height) of the polishing pad 14 on a display (not shown), for example. Thereby, an operator can visually recognize the distribution of the thickness of the polishing pad 14.

Moreover, the computing apparatus 24 comprises an estimation chart showing the relationship between the shape of a polishing pad measured in a state of being attached to a plate and the shape of a wafer polished by the polishing pad. By this estimation chart, a target shape of a polishing pad so that a wafer has a desired surface shape (typically flat) and the current polishing pad shape obtained by the polishing pad shape measuring apparatus 10 are compared. Also, by providing this estimation chart in the computing apparatus 24, it is possible to calculate and display the dressing conditions (dressing recipe) and the like for modifying the measured polishing pad shape into the target shape. Therefore, an operator can modify the shape of a polishing pad without depending on visual sense or the degree of proficiency, which enables stable quality control.

Figure 2:
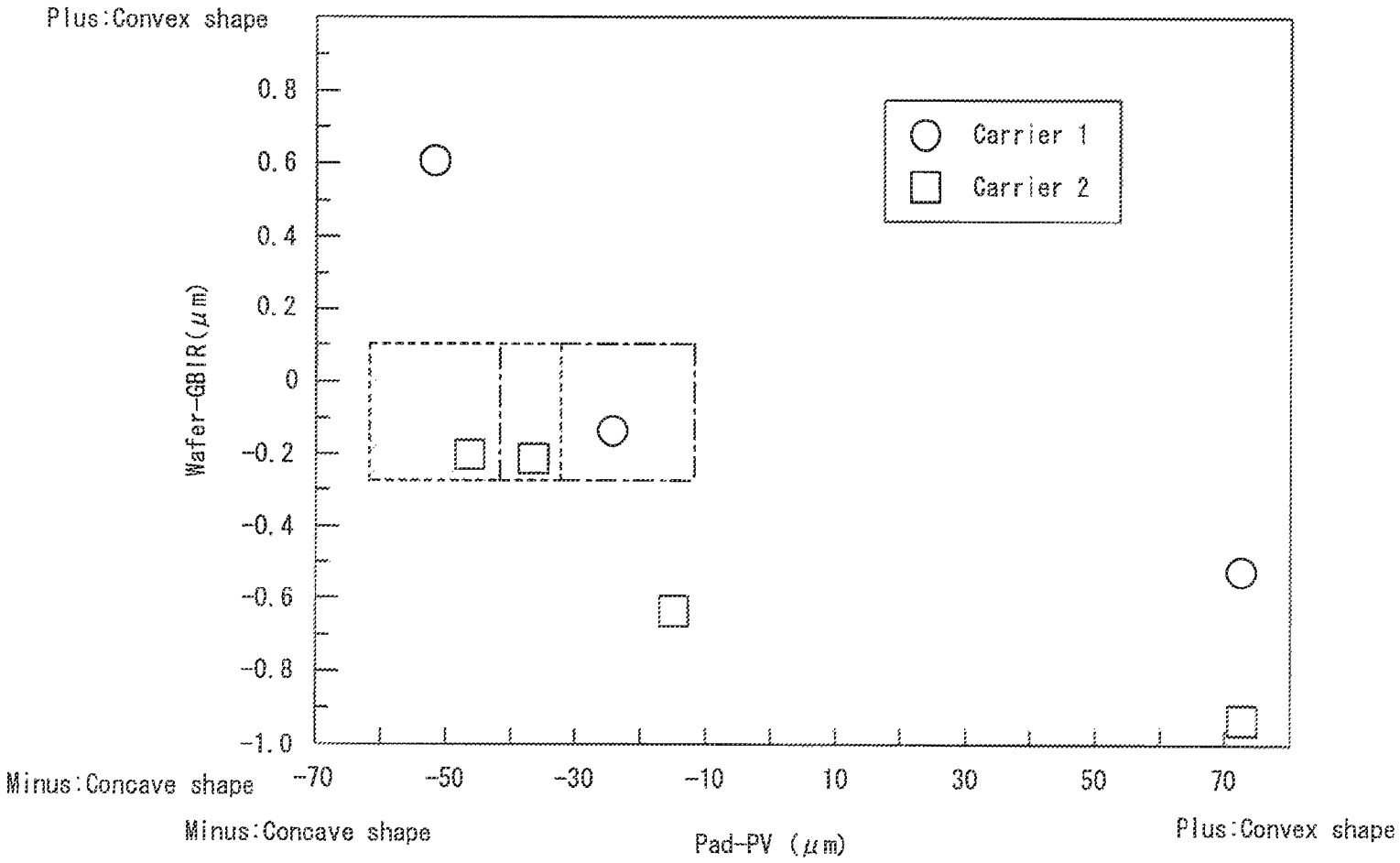
FIG. 2 is an illustrative view of the estimation chart used in the method according to the invention.

FIG. 2 is a graph showing the relationship between the shape of a polishing pad and the resulting wafer after polishing processing by the polishing pad, as an example of this estimation chart. In addition, the graph of FIG. 2 has a traverse axis of the PV (peak value) of a polishing pad and a longitudinal axis of the GBIR (Global Back-side Ideal Range) value of a wafer. Also, for reference, two kinds of carriers used for polishing are shown in the same graph. In addition, the invention is not limited to the above indexes, but various indexes such as the GFIR (Global Front Least Square Range) value may be used appropriately. Also, for the purpose of calculating and displaying the dressing conditions, an estimation chart not in the graph form but in the form of numerical database may be provided in the computing apparatus 24.

As is clear from the estimation chart shown in FIG. 2, in order to polish and planarize a wafer, it is not necessarily the most suitable to planarize a polishing pad. More specifically, in order to planarize a wafer with a high degree of accuracy, it is required to process (modify) a polishing pad in advance into a shape capable of planarizing a wafer.

In the method for modifying a polishing pad shape according to the invention, a polishing pad shape is modified by dressing selectively using a dressing tool, normally for removing the clogging of the polishing pad, depending on the polishing pad shape.

Figure 3:
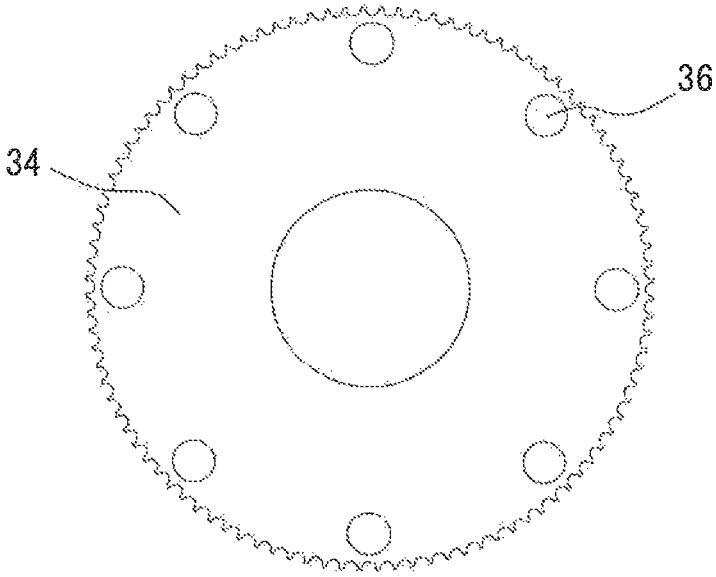
FIG. 3 is an illustrative view of the dressing tool used in the method according to the invention.
Figure 3:
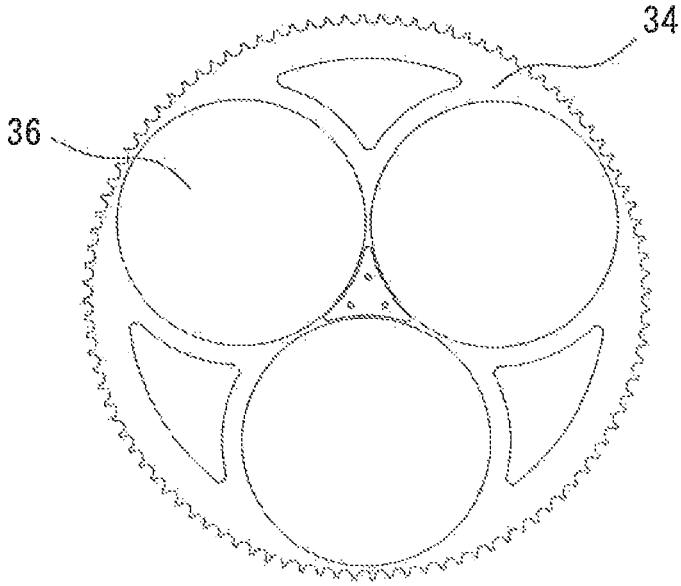

FIG. 3 shows two kinds of dressing tools, a dressing tool for pad outer periphery portion modification and a dressing tool for pad center portion modification, as examples of the dressing tools used for performing the invention. These dressing tools are set in holding holes provided in a carrier plate (not shown), the carrier plate and the dressing tools are rotated in a state being sandwiched between an upper plate and a lower plate, and polishing pads attached to the upper plate and the lower plate are dressed.

FIG. 3(*a*) is the dressing tool for pad outer periphery portion modification, which has dressing pellets 36 arranged at even intervals in the vicinity of the outer periphery portion of a dressing plate 34. When this dressing tool is used, the outer periphery portion of a polishing pad is more strongly dressed and the PV has a property of shifting in a plus direction. Meanwhile, FIG. 3(*b*) is the dressing tool for pad center portion modification, which has dressing pellets 36 arranged at even intervals in the vicinity of the center portion of the dressing plate 34. When this dressing tool is used, the center portion of a polishing pad is more strongly dressed and the PV has a property of shifting in a minus direction.

In the method for modifying a polishing pad shape according to the invention, by selectively using dressing tools with different properties (as shown in FIG. 3), the PV of a polishing pad is modified into the most suitable for making a wafer to be in a desired surface shape. In addition, although the example of using two kinds of dressing tools has been described herein for simplification, it is also possible to use more kinds of dressing tools and make finer modifications to a polishing pad. Moreover, the index for the shape of a polishing pad is not limited to the PV, and it is also possible to use more indexes and define the most suitable polishing pad shape as a target in more details.

Hereinafter, the procedure of wafer polishing using the method for modifying a polishing pad shape according to the invention will be described with reference to the flow chart shown in FIG. 4.

Figure 4:
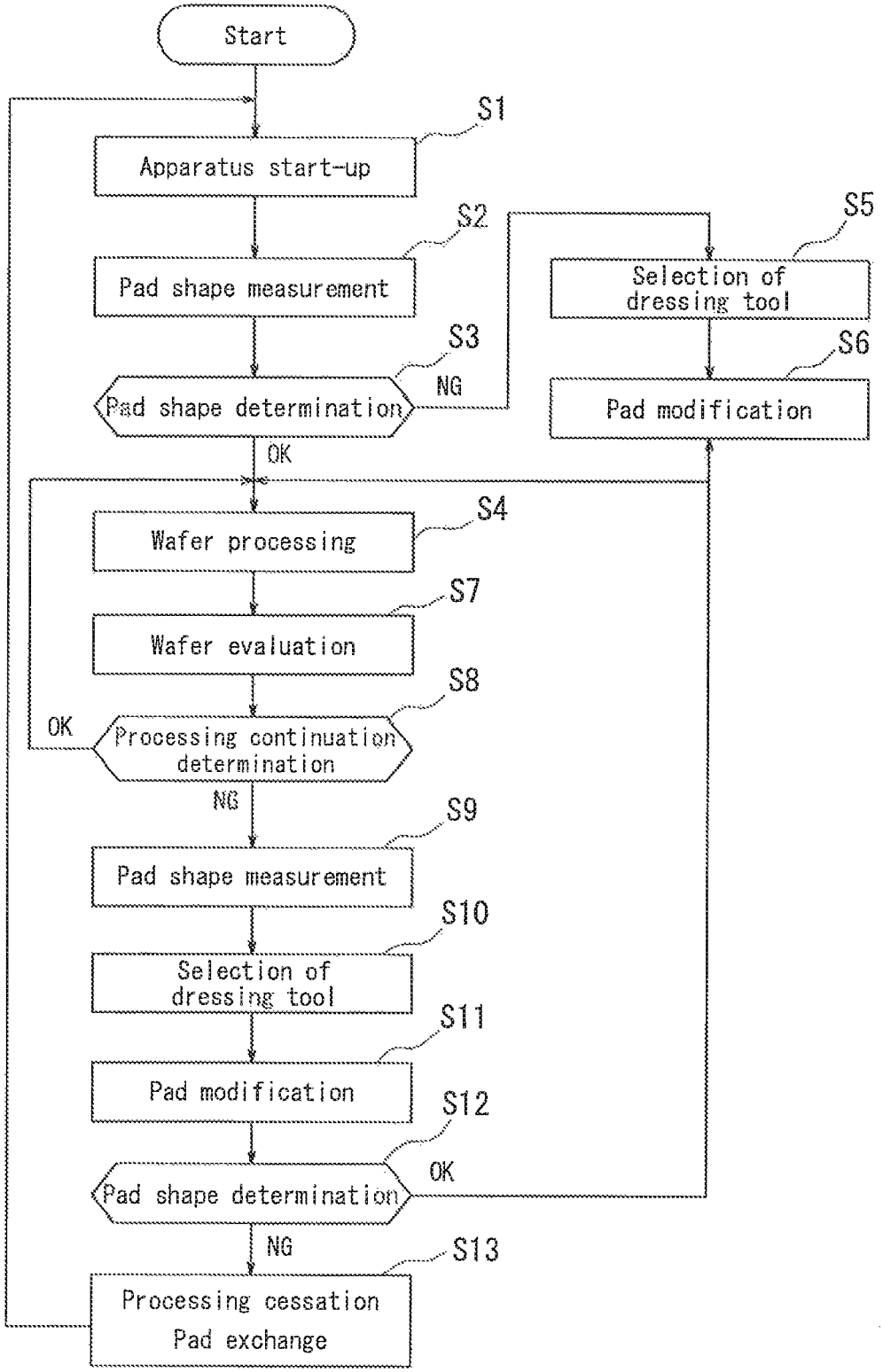
FIG. 4 is a representative flow chart for performing the method according to the invention.

The wafer polishing process shown in FIG. 4 starts from the start-up of a polishing apparatus (step S1). In this step, preparations such as attaching a polishing pad to a plate of the polishing apparatus are conducted.

Next, a polishing pad shape is measured (step S2). Now, the polishing pad shape measuring apparatus 10 described with FIG. 1 can be used for measuring the polishing pad shape. More specifically, the polishing pad shape here does not mean the shape of a polishing pad itself, but the shape of a polishing pad in a state of being attached to a plate.

Then, it is determined whether the measured polishing pad shape is suitable for making a wafer to be in a desired surface shape or not (step S3). Also, when the shape is not suitable for making a wafer to be in a desired surface shape, the difference with a suitable shape is obtained simultaneously. Now, the estimation chart illustrated with FIG. 2 can be used for determining the polishing pad shape. When the shape is determined to be suitable for making a wafer to be in a desired surface shape (OK), the procedure proceeds to the next step of a wafer processing (step S4), and when the shape is determined to be unsuitable for making a wafer to be in a desired surface shape (NG), the procedure proceeds to the next step of a dressing tool selection (step S5).

In the step S5, based on the determination result in the step 3, a dressing tool for modifying the polishing pad shape is selected (step S5). Here, the method for selecting a dressing tool selects a dressing tool shifting the PV in a plus direction (e.g., the one in FIG. 3(*a*)) or a dressing tool shifting the PV in a minus direction (e.g., the one in FIG. 3 (*b*)) by focusing attention on the PV, in the example using the above estimation chart. Moreover, not only selecting a dressing tool to be used, but the dressing conditions such as the dressing time are also determined from data in the estimation chart.

Subsequently, the polishing pad shape is modified (dressed) by using the selected dressing tool (step S6). As the polishing pad obtains the most suitable shape for wafer polishing by this dressing step, the procedure proceeds to the step S4 after the step S6.

In the step S4, a wafer is processed. More specifically, a wafer is introduced in a polishing apparatus and polished by the polishing pad. After this polishing, the polished wafer is evaluated (step S7), and the continuation of processing is determined (step S8). Here, it is confirmed whether the wafer is polished at a predetermined accuracy, and thereby the wear of the polishing pad is confirmed. When the wafer is polished at a predetermined accuracy, a loop of the step S4, the step S7 and the step S8 is repeated, and when the wafer is not polished at a predetermined accuracy, it is determined that the polishing pad is worn away (step S8).

When the polishing pad is determined to be worn, the polishing pad shape is measured (step S9). Here, similarly to the step S3, it is also possible to use the polishing pad measuring apparatus 10 described with FIG. 1 to measure the polishing pad shape. More specifically, the polishing pad shape here also means the shape of the polishing pad in a state of being attached to the plate, not the shape of the polishing pad itself. Moreover, from the measured polishing pad shape, the difference with a suitable pad shape for wafer polishing is obtained simultaneously. It is also possible to use the estimation chart illustrated with FIG. 2 for this polishing pad evaluation.

Next, based on the measurement result in the step S9, a dressing tool for modifying the polishing pad shape is selected (step S10). Here, similarly to the step S5, a dressing tool shifting the PV in a plus direction (e.g., the one in FIG. 3(*a*)) or a dressing tool shifting the PV in a minus direction (e.g., the one in FIG. 3(*b*)) is selected by focusing attention on the PV. Moreover, not only selecting a dressing tool to be used, but the dressing conditions such as the dressing time are also determined from data in the estimation chart.

Subsequently, the polishing pad shape is modified (dressed) by using the selected dressing tool (step S11). Then, it is determined whether the polishing pad obtains the most suitable shape for wafer polishing by this dressing step or not (step S12).

In this step S12, when the polishing pad is determined to have the most suitable shape for wafer polishing, the procedure returns to the wafer processing of the step S4 and repeats the loop of the step S4, the step S7 and the step S8 again.

In the step S12, when the polishing pad is determined not to have the most suitable shape for wafer polishing, which is equivalent to when the polishing pad is too thin to make modifications, polishing processing is ceased, and the polishing pad is exchanged (step S13). Then, after the polishing pad exchange, the procedure returns to the step S1 and restarts the wafer polishing process.

According to the wafer polishing process described above, since a polishing pad shape can also be modified simultaneously with a dressing, originally for removing the clogging, there is an advantage that a polishing pad does not need to be exchanged unless a polishing pad becomes too thin to make modifications.

According to the invention, since a surface shape of a polishing pad in a state of being attached to a plate is also modified simultaneously with a dressing, originally for removing the clogging, a polishing pad shape is always maintained in the best condition, and the exchange frequency of the polishing pad is reduced. Therefore, the invention can be used suitably in the wafer polishing process.

What is claimed is:

1. A method for shape modification of a polishing pad for polishing a workpiece into a desired surface shape, comprising:

a measurement step of measuring a polishing pad shape in a state of being attached to a plate by using a polishing pad shape measuring apparatus, wherein the polishing pad shape measuring apparatus comprises a computing apparatus, the computing apparatus has data showing the relationship between the polishing pad shape and a shape of the workpiece polished by the polishing pad, and the shape of the polished workpiece is estimated from the measurement result of the measurement step and a comparison to the data showing the relationship between the polishing pad shape and a finished shape of the workpiece polished by the polishing pad;

a condition determination step of selecting a dressing recipe capable of dressing the polishing pad to allow the polishing pad to polish the workpiece into the desired surface shape from a plurality of pre-provided dressing recipes based on the measurement result of the measurement step; and a shape modification step of dressing the polishing pad by using the dressing recipe determined in the condition determination step.

2. A method for shape modification of a polishing pad according to claim 1, wherein the dressing recipe is determined by selecting the most suitable dressing tool from a plurality of dressing tools.

3. A method for shape modification of a polishing pad according to claim 2, wherein the plurality of dressing tools contains at least a dressing tool with a property of modifying the polishing pad from a convex surface to a concave surface and a dressing tool with a property of modifying the polishing pad from a concave surface to a convex surface.

4. A method for shape modification of a polishing pad according to any one of claims 1 to 3, wherein the dressing recipe determines at least one of a dressing time, a dressing pressing force, and a dressing tool rotation frequency.

5. A method for shape modification of a polishing pad according to claim 1, wherein the data is data showing the relationship between a Peak Value of the polishing pad and a Global Backside Ideal Range value of the wafer.

6. A method for shape modification of a polishing pad for polishing a workpiece into a desired surface shape, comprising:

a measurement step of measuring a polishing pad shape in a state of being attached to a plate by using a polishing pad shape measuring apparatus, wherein the polishing pad shape measuring apparatus comprises a computing apparatus, the computing apparatus has data showing the relationship between a Peak Value of the polishing pad and a Global Backside Ideal Range value of the wafer, and the shape of the polished workpiece is estimated from the measurement result of the measurement step;

a condition determination step of selecting a dressing recipe capable of dressing the polishing pad to allow the polishing pad to polish the workpiece into a desired surface shape from a plurality of pre-provided dressing recipes based on the measurement result of the measurement step; and a shape modification step of dressing the polishing pad by using the dressing recipe determined in the condition determination step, wherein the dressing recipe is determined by selecting the most suitable dressing tool from a plurality of dressing tools.

7. A method for shape modification of a polishing pad according to claim 6, wherein the plurality of dressing tools contains at least a dressing tool with a property of modifying the polishing pad from a convex surface to a concave surface and a dressing tool with a property of modifying the polishing pad from a concave surface to a convex surface.

8. A method for shape modification of a polishing pad for polishing a workpiece into a desired surface shape, comprising:

a measurement step of measuring a polishing pad shape in a state of being attached to a plate by using a polishing pad shape measuring apparatus, wherein the polishing pad shape measuring apparatus comprises a computing apparatus, the computing apparatus has data showing the relationship between a Peak Value of the polishing pad and a Global Backside Ideal Range value of the wafer, and the shape of the polished workpiece is estimated from the measurement result of the measurement step;

a condition determination step of selecting a dressing recipe capable of dressing the polishing pad to allow the polishing pad to polish the workpiece into a desired surface shape from a plurality of pre-provided dressing recipes based on the measurement result of the measurement step; and a shape modification step of dressing the polishing pad by using the dressing recipe determined in the condition determination step, wherein the dressing recipe determines at least one of a dressing time, a dressing pressing force, and a dressing tool rotation frequency.

* * * * *